US006024679A

United States Patent [19]

Castallanos et al.

[11] Patent Number: 6,024,679

[45] Date of Patent: Feb. 15, 2000

[54] COMPACT EXERCISE DEVICE

[76] Inventors: Edward Castallanos, 403 Old Bridge Rd., Brielle, N.J. 08730; Richard Russinko, 65 Orchard St., Hamburg, N.J. 07419

[21] Appl. No.: 09/028,393

[22] Filed: Feb. 24, 1998

Related U.S. Application Data

[60] Provisional application No. 60/044,609, Apr. 24, 1997.

[51] Int. Cl.[7] ..... A63B 21/02

[52] U.S. Cl. ..... 482/140; 482/142

[58] Field of Search ..... 482/79, 80, 51, 482/105, 106, 110, 92, 121–123, 131, 139, 140, 148, 907, 908, 142; 601/23, 24, 27, 33–35; D21/686, 687, 681, 691

[56] References Cited

U.S. PATENT DOCUMENTS

| | | | |
|---|---|---|---|
| D. 216,529 | 2/1970 | Bock | D21/687 |
| D. 262,394 | 12/1981 | Hain | D21/691 |
| D. 385,601 | 10/1997 | Uen | D21/691 |
| D. 400,953 | 11/1998 | Huang | D21/687 |
| 4,638,995 | 1/1987 | Wilson | 482/139 |
| 4,863,158 | 9/1989 | Tassone | 482/140 |
| 5,016,874 | 5/1991 | Boardman | 482/122 |
| 5,122,107 | 6/1992 | Gardner | 482/140 |
| 5,514,058 | 5/1996 | Buoni et al. | 482/124 |
| 5,637,067 | 6/1997 | Ausmus | 482/140 |
| 5,752,903 | 5/1998 | Chang | 482/140 |
| 5,792,035 | 8/1998 | Ward et al. | 482/140 |

*Primary Examiner*—Richard J. Apley
*Assistant Examiner*—Lori Lynn Baker-Smith
*Attorney, Agent, or Firm*—Mathews, Collins, Shepherd & Gould, P.A.

[57] ABSTRACT

In accordance with the invention, an exercise device comprises a pair of arms disposed apart from each other, a flexible strap extending between the arms and a support pad held by the strap. A stabilizer bar can hold the arms in spaced apart relation. In a preferred embodiment, the device is in the form of a truncated letter "A", having the stabilizer bar as the top horizontal segment of the letter, the arms as the two diverging sides and the strap as the inner horizontal segment. In use to assist abdominal exercise, the pad supports the head and neck, and the harness arms extend over the user's shoulders to avoid curling the shoulders. Extensions of the stabilizer bar can provide hand grips. One can also use the harness arms to support the torso in various exercises. The device can also be used to support the knee or leg in therapy.

21 Claims, 3 Drawing Sheets

COMPACT EXERCISE DEVICE

CROSS REFERENCE TO RELATED APPLICATIONS

This application claims the benefit of Provisional Application No. 60/044,609 entitled "Compact Abdominal Exerciser" filed by the applicant on Apr. 24, 1997.

FIELD OF THE INVENTION

This invention relates to a device useful for assisting in exercise or physical therapy. The device is particularly useful for assisting in exercise of the abdomen, back and torso and can also be used to provide support of the head, arms and legs in physical therapy.

BACKGROUND OF THE INVENTION

Unassisted exercises for the abdomen, back and torso have proven less than satisfactory. One of the main difficulties is that unassisted exercises often must be performed in postures that are less than optimal for desired isolation and effect. For example, unassisted sit-ups and "crunches" provide good exercise for the abdominal muscles, but they are difficult to perform in good form and impose unnecessary strain on the neck, shoulders and lower back. To reduce strain on the neck, a person typically puts his hands behind his neck for support, and this posture, in turn, undesirably curls the shoulders inwardly.

A variety of machines have been developed to assist in abdominal exercises. In one known machine, the user is seated in an upright position and curls and uncurls his body against an adjustable resistance. Such machines are relatively expensive and bulky.

More recently an exercise device known as an abdominal roller ("ab roller") has enjoyed great popularity. The device provides a neck support rigidly connected between a pair of curved rocker arms. While the ab roller assists isolating the abdominal muscles, because of the rigid support, the motion of the neck is determined solely by the curved arms of the machine, not by the anatomy of the user. Since users differ considerably, the machine-constrained motion is inappropriate for many. Moreover the ab roller occupies a considerable volume, is bulky for transport, and exercises only one muscle group. Accordingly, there is a need for a more compact and versatile device for assisting exercise.

It is another object of the invention to provide support to the head and neck and the extremities (arms and legs) in other applications such as physical therapy or therapeutic massage.

SUMMARY OF THE INVENTION

In accordance with the invention, an exercise device comprises a pair of arms disposed apart from each other, a flexible strap extending between the arms and a support pad held by the strap. A stabilizer bar can hold the arms in spaced apart relation. In a preferred embodiment, the device is in the form of a truncated letter "A", having the stabilizer bar as the top horizontal segment of the letter, the arms as the two diverging sides and the strap as the inner horizontal segment. In use to assist abdominal exercise, the pad supports the head and neck, and the harness arms extend over the user's shoulders to avoid curling the shoulders. Extensions of the stabilizer bar can provide hand grips. One can also use the harness arms to support the torso in various exercises. The device can also be used to support the knee or leg in therapy.

BRIEF SUMMARY OF THE DRAWINGS

The nature, advantages and various additional features of the invention will appear more fully upon consideration of the illustrative embodiments now to be described in detail in connection with the accompanying drawings. In the drawings.

DETAILED DESCRIPTION

Figure 1:
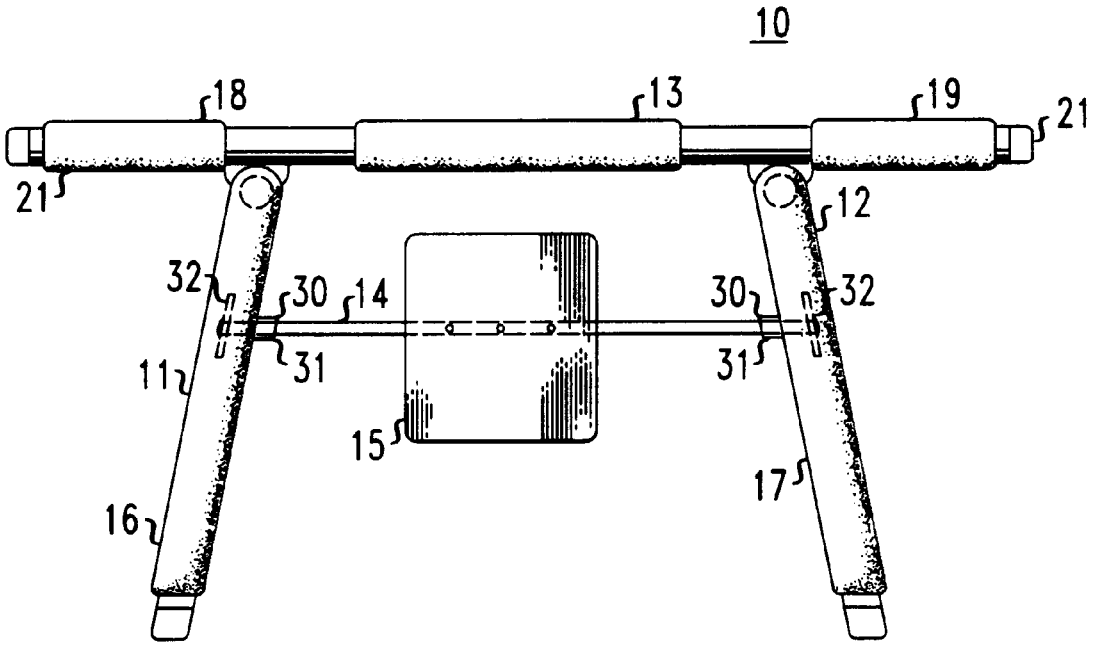
FIG. 1 is the front view of an exercise device in accordance with a preferred embodiment of the invention.

Referring to the drawings, FIG. 1 is a front view of an exercise device 10 comprising a rigid support frame composed of a pair of harness arms 11 and 12 held in spaced apart position by a stabilizer bar 13. Conveniently, the harness arms can be attached to the stabilizer bar by threaded screws, welding or a snap-on device. A flexible strap 14, which is preferably elastic, extends between the arms 11 and 12 and is fixed to them. A support pad 15 is held by the flexible strap 14 approximately midway between the two arms. Preferably the support pad 15 is curved to provide comfortable support to the neck between the shoulders and the head. Arms 11 and 12 advantageously spread apart as they extend away from the stabilizer bar 13 and are conveniently provided with hand grips 16 and 17 such as foam rubber near the ends away from the stabilizer. As shown in the drawing, the overall configuration viewed from above can be in the form of a truncated letter "A".

Figure 2:
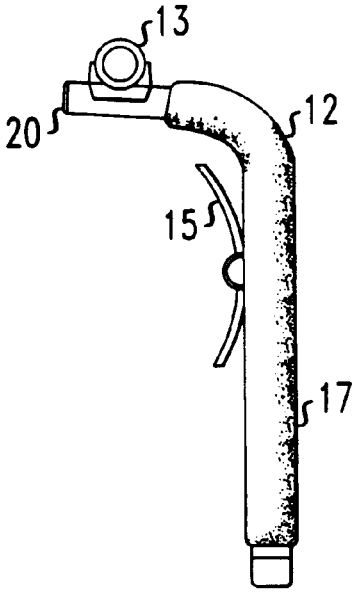
FIG. 2 is a side view of the device of FIG. 1.

In a preferred embodiment, the stabilizer bar extends beyond the harness arms on either side and conveniently includes hand grips 18 and 19 covered with elastomeric material near the projecting end portions. These extensions can be curved to permit variations of the user's grip. As better seen in the side view of FIG. 2, the top portions of arms 11, 12 are preferably curved downward to form support portions 20 for supporting the upper portion of the device above a floor. The stabilizer bar 13 is preferably attached to the support portions 20 at a position displaced from the plane of the A-frame by a distance in the range of one to nine inches. The bar 13 is advantageously supported at least one inch and preferably 1–3 inches from the ends of portions 20 for ease in grasping the hand grips when the support portions rest upon a floor.

Progressive/overload resistance can optionally be applied by making the arms and/or stabilizer bar of hollow tubing and simply adding weights, such as lead cylinders, to the interior of the stabilizer bar or the arms. The stabilizer bar can be detachable from at least one arm to facilitate the insertion of weights. Alternatively the stabilizer bar or the harness arms can have removable end caps 21 for permitting the insertion of weights.

The support frame can be conveniently fabricated of plastic or metal tubing, such as 1 inch diameter PVC pipe or steel tubing. The strap can be rubber strapping, and the neck pad can be curved semirigid plastic with adhered foam rubber padding. In the preferred embodiment, the harness arms 11, 12 diverge, each intersecting the stabilizer bar at an angle in the range 70°–110°.

To facilitate connection of the strap 14 to the harness arms 11, 12, the arms can include T-bars 30 having medial openings 31 with circumferential lips surrounding the openings. The strap 14 can then be fastened to elongated inserts 32 within the arms. The T-bar segments can be integral with the arms or can be detachable pieces, adjustable by rotation to provide a range of support positions for the pad. Alternatively the strap can be attached to the back of the harness arms as by a threaded screw.

Figure 3:
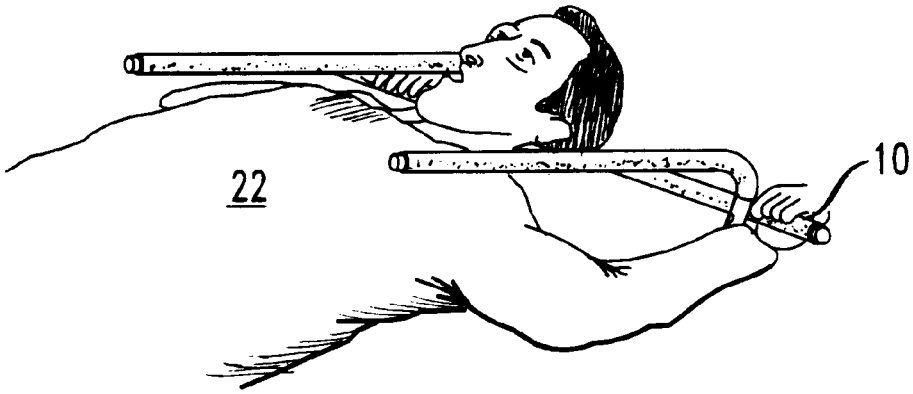
FIG. 3 illustrates the use of the FIG. 1 device to support the neck, as in abdominal exercise.

In abdominal exercise, as depicted in FIG. 3, the user 22 lies back on the upper portion of device 10 with the pad 15 behind his head or neck and the harness arms 11, 12 over the shoulders. When he or she lies back, the pad supports the neck and head in an elastic manner and the stabilizer bar provide hand grips 18, 19 without requiring the shoulders to curl inward. Extension of the arms 11, 12 over the user's shoulders prevents the shoulders from curling or moving forward. A sit-up or crunch can then be performed in proper posture without undue stress on the neck or the spine. Alternatively, the device 10 can be inverted from the FIG. 3 position (stabilizer bar up) to provide a greater range of motion.

Figure 4:
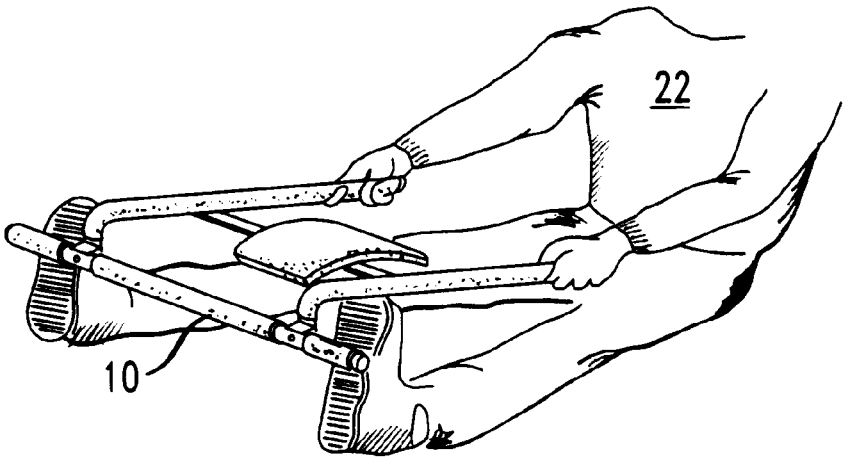
FIG. 4 illustrates the use of the FIG. 1 device to facilitate stretching exercise.

One can also use the device 10 to facilitate stretching the legs as depicted in FIG. 4. Here the user 22 hooks the stabilizer bar extensions 18, 19 against the front part of the feet and grasps the harness arms at 16, 17 to facilitate stretching the hamstrings.

Figure 5:
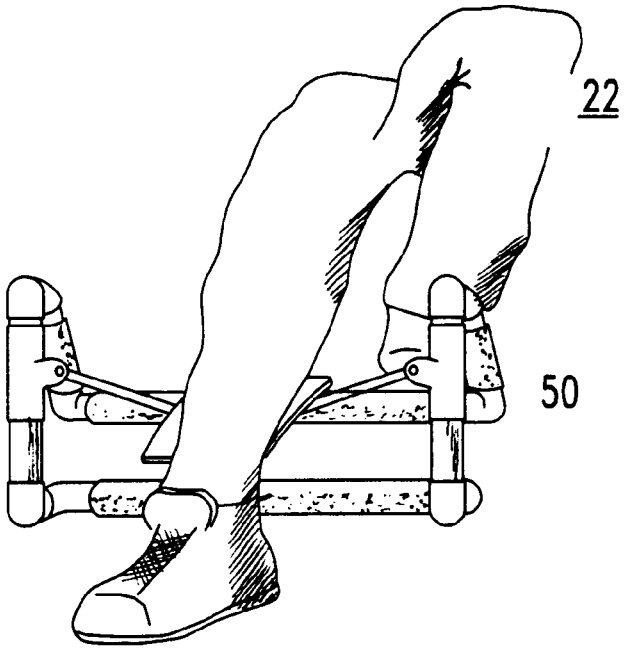
FIG. 5 is a side view of an alternative embodiment using harness arms that are curved at both ends.

FIG. 5 is an elevated side view of an alternative embodiment 50 of the device of FIG. 1 wherein each of the arms 11, 12 is curved near both ends. Each arm is "U" shaped in side view, and the arms are connected to two stabilizer bars 13. Alternatively, only one stabilizer bar can be used and each arm provides support portions 20, 23 on both ends. In the latter case, the supports 20, 23 maintain the remainder of arms 11, 12 above a user's shoulders.

Figure 6:
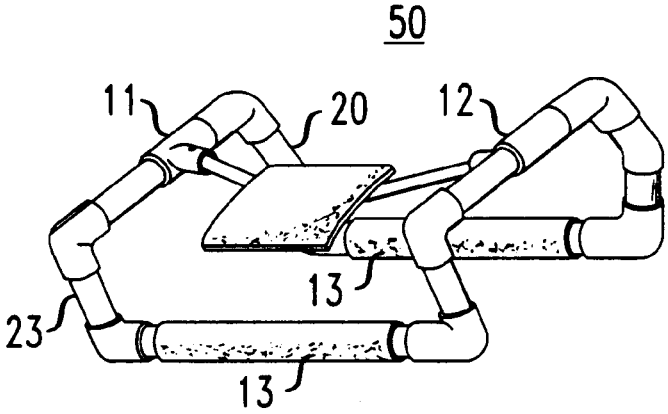
FIG. 6 illustrates the use of the FIG. 5 device to support the leg.

While this device is primarily used to support the neck, head and torso in exercise, it can also be used to support these and other extremities in physical therapy or therapeutic massage. FIG. 6 shows the device of FIG. 5 used to support the knee from below in order to facilitate therapy or stretching exercise. The elastically supported pad provides a particularly comfortable support as compared with conventional rigidly mounted pads.

It is to be understood that the above-described embodiments are illustrative of only a few of the many possible specific embodiments which can represent applications of the principles of the invention. For example, the stabilizer bar can be coplanar with the harness arms, and it need not extend beyond the arms. Moreover, the entire support frame can be a single piece of bent tubing, and with a sufficiently large bend radius, the arm portions of the structure will fit over the shoulders to prevent curling even without the arms spreading (i.e. a frame "U" shaped in top view can be used). Thus numerous and varied other arrangements can be made by those skilled in the art without departing from the spirit and scope of the invention.

What is claimed:

1. An exercise device useful in supporting a human user's body parts above an underlying floor during exercise or physical therapy comprising:

a frame having a top horizontal bar, a flexible inner horizontal segment, and a pair of side arms disposed substantially parallel and apart from each other as to define a space between them, each said side arm having a first end and a second end, wherein adjacent the first end of each side arm is a curved section for supporting a portion of the frame above the floor, and the top horizontal bar is transversely attached to the pair of side arms adjacent the curved section of each arm thereby holding said pair of side arms in spaced-apart relation;

and wherein the flexible inner horizontal segment extends between said side arms and is attached thereto at a position intermediate the ends of said side arms, the flexible inner horizontal segment including a support region in said space between said side arms for supporting a user's body part above the floor.

2. The exercise device of claim 1 in which said inner horizontal segment comprises a strap and said support region comprises a support pad held by said strap.

3. The exercise device of claim 1 in which said second ends of each of said side arms comprise free ends.

4. The exercise device of claim 1 wherein said top horizontal bar projects laterally beyond said side arms to provide grips.

5. The exercise device of claim 4 wherein said top horizontal bar projecting laterally beyond said side arms is curved for permitting variation in the location of a user's hold on said grips.

6. The exercise device of claim 4 wherein said grips comprise elastomeric material.

7. The exercise device of claim 1 wherein said side arms define a plane and said top horizontal bar is displaced from said plane by a distance in the range of 1 to 9 inches.

8. The exercise device of claim 1 wherein said side arms are dimensioned and positioned to extend over the shoulders of a user providing support for a user's head without curling of the user's shoulders.

9. The exercise device of claim 1 wherein at least one of said side arms or said top horizontal bar are hollow such that weights can be added to the interior of a hollow member for applying resistance.

10. The exercise device of claim 1 wherein said side arms intersect the top horizontal bar at an angle such that the side arms spread apart as they extend away from the top horizontal bar.

11. The exercise device of claim 10 wherein said angle is in the range 70° to 110°.

12. The exercise device of claim 1 wherein said inner horizontal segment comprises elastomeric material.

13. The exercise device of claim 1 wherein at least one of said side arms further comprises a T-bar segment to facilitate connection with said flexible inner horizontal segment.

14. The exercise device of claim 13 wherein said T-bar is molded to said at least one side arm.

15. The exercise device of claim 13 wherein said T-bar comprises a separate detachable piece that can be removed from said at least one side arm.

16. The exercise device of claim 13 wherein said T-bar is rotatably adjustable for providing a range of support positions.

17. The exercise device of claim 2 wherein said support pad is curved to accommodate a user's neck and comprises an elastomeric padding surface.

18. The exercise device of claim 1 wherein the adjacent second end of each said arm there is a curved section such that each side arm is substantially u-shaped.

19. The exercise device of claim 18 further comprising a second horizontal bar transversely attached to said pair of side arms adjacent the curved section at the second end of each arm.

20. The exercise device of claim 1 wherein said top horizontal bar is connected to said side arms at least one inch above the first end of each of said side arms.

21. The exercise device of claim 1 in which said side arms are attached to said top horizontal bar by at least one of threaded screws, welding, or snap-on devices.

* * * * *